US006070501A

United States Patent [19]

Braun et al.

[11] Patent Number: 6,070,501

[45] Date of Patent: Jun. 6, 2000

[54] MINI RATCHETING SCREWDRIVER WITH LATCHING SWIVELING HANDLE

[75] Inventors: John A. Braun, Kenilworth; Tomas B. Petruzzi, Rockaway, both of N.J.

[73] Assignee: Snap-on Tools Company, Kenosha, Wis.

[21] Appl. No.: 09/143,552

[22] Filed: Aug. 31, 1998

[51] Int. Cl.[7] ..... B25B 13/46

[52] U.S. Cl. ..... 81/62; 192/43.1

[58] Field of Search ..... 81/62, 63.1, 58, 81/58.1; 192/43.1

[56] References Cited

U.S. PATENT DOCUMENTS

| | | | |
|---|---|---|---|
| 391,655 | 10/1888 | Smith . | |
| 610,773 | 9/1898 | Smith . | |
| 751,496 | 2/1904 | Gode . | |
| 818,761 | 4/1906 | Hanes et al. . | |
| 1,314,012 | 8/1919 | Mowers . | |
| 1,381,900 | 6/1921 | Barnes . | |
| 2,013,765 | 9/1935 | Richardson . | |
| 2,463,221 | 3/1949 | Van Hoose . | |
| 2,564,356 | 8/1951 | Dianda | 81/61 |
| 3,222,943 | 12/1965 | McDonald | 81/63.1 |
| 3,255,792 | 6/1966 | Beck | 81/438 |
| 3,256,966 | 6/1966 | Angquist | 81/62 |
| 3,269,228 | 8/1966 | Mack . | |
| 3,356,117 | 12/1967 | Wagner . | |
| 3,693,484 | 9/1972 | Snaderson, Jr. . | |
| 4,341,293 | 7/1982 | Acevedo . | |
| 4,631,988 | 12/1986 | Colvin . | |
| 4,699,028 | 10/1987 | Bosque . | |
| 5,052,253 | 10/1991 | Lin . | |
| 5,105,688 | 4/1992 | Williams, III . | |
| 5,722,307 | 3/1998 | Chen . | |

*Primary Examiner*—James G. Smith
*Assistant Examiner*—David B. Thomas
*Attorney, Agent, or Firm*—Seyfarth, Shaw, Fairweather & Geraldson

[57] ABSTRACT

A ratchet tool has a ratchet body carrying a ratchet mechanism including a gear and a pair of pawls resiliently urged into engagement with the gear by spring-loaded balls. A handle is releasably received on a post which projects from one end of the ratchet body and is retained thereon by a spring-loaded ball receivable in a circumferential groove in the handle bore to accommodate free spinning thereof. A latching pin in the handle is selectively insertable in any of a plurality of recesses in the ratchet body to lock the handle to the body. A reversing sleeve is rotatably carried by the other end of the ratchet body for engaging the pawls to selectively control the direction of the ratcheting movement. The reversing sleeve has a tubular post which forms a part of an axial push-pull quick-release coupler for releasably retaining a bit in engagement in an axial bore of the ratchet gear.

20 Claims, 5 Drawing Sheets

MINI RATCHETING SCREWDRIVER WITH LATCHING SWIVELING HANDLE

BACKGROUND OF THE INVENTION

It is known to provide ratchet tools with various types of interchangeable workpiece-engaging portions. For example, standard ratchet wrenches are well known with drive lugs which can accommodate any of a number of socket tools or the like for driving various types of fasteners. Similarly, it is known to provide ratchet tools with shaft-like bits, such as screwdriver bits, wherein the screwdriver bit can be removed and/or interchanged. However, in such devices the workpiece-engaging member of the tool typically either cannot be latched in place on the ratchet mechanism or is semi-permanently retained in place, such as by a set screw, which requires considerable manipulation for disengagement.

Similarly, it is known to provide ratchet tools with adjustable and/or removable handle portions but, again, such portions either are not latchable in place or they require considerable effort to disengage and/or remove. Also, it is known to provide ratcheting tools with spinning-type handles, which are capable of free-spinning movement relative to the ratchet mechanism. Heretofore such spinning-type handles have not been removable from the ratchet mechanism.

SUMMARY OF THE INVENTION

It is a general object of the invention to provide an improved ratchet tool which avoids the disadvantages of prior ratchet tools while affording additional structural and operating advantages.

An important feature of the invention is the provision of a ratchet tool which has a ratchet mechanism to which both a workpiece-engaging portion and a handle portion can be quick-release coupled for easy disengagement and interchangability.

In connection with the foregoing feature, another feature of the invention is the provision of a ratchet tool of the type set forth, wherein the workpiece-engaging portion can be latched to the ratchet mechanism.

Still another feature of the invention is the provision of a ratchet tool of the type set forth, wherein the handle is capable of operation in either a free-spinning or locked mode relative to the ratchet mechanism.

Yet another feature of the invention is the provision of a ratchet tool of the type set forth which is of simple and economical construction, capable of relatively easy assembly and disassembly.

Certain ones of these and other features of the invention are attained by providing a ratchet tool for driving a bit comprising: a ratchet mechanism having a body, a first quick-release coupling mechanism carried by the body and releasably coupling a bit to the ratchet mechanism, a handle, and a second quick-release coupling mechanism releasably coupling the handle to the ratchet mechanism.

Other features of the invention may be attained by providing a ratchet tool comprising a ratchet mechanism having a body, a handle, and coupling mechanism for coupling the handle to the ratchet mechanism, the coupling mechanism including a retaining portion operable for retaining the handle on the ratchet mechanism and accommodating relative rotational movement of the handle and the ratchet mechanism about a common axis, and a latching portion selectively operable for preventing relative rotational movement of the handle and the latching mechanism.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
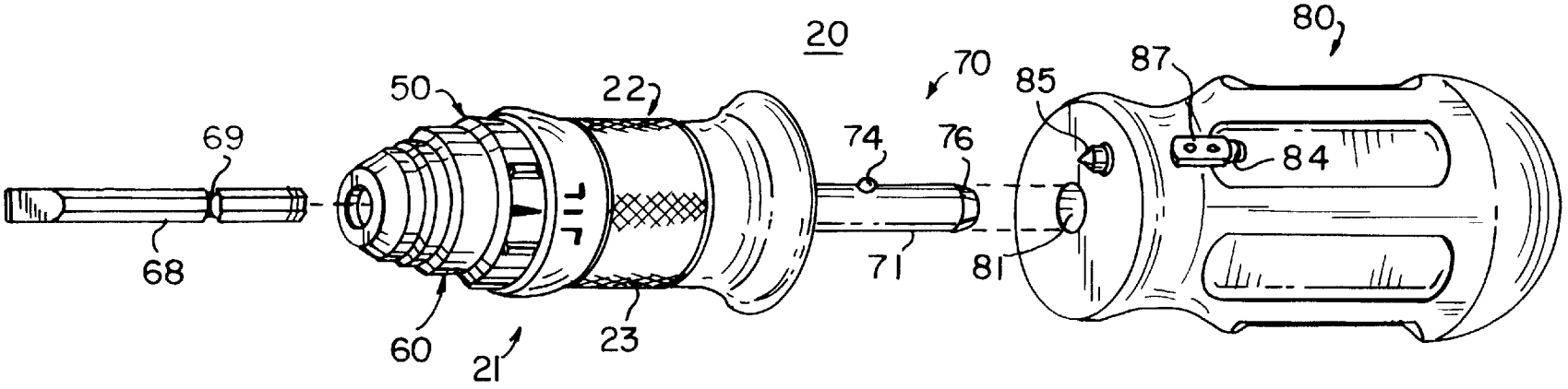
FIG. 1 is a perspective view of the ratchet tool of the present invention showing the handle and associated bit disengaged from the ratchet mechanism.
Figure 2:
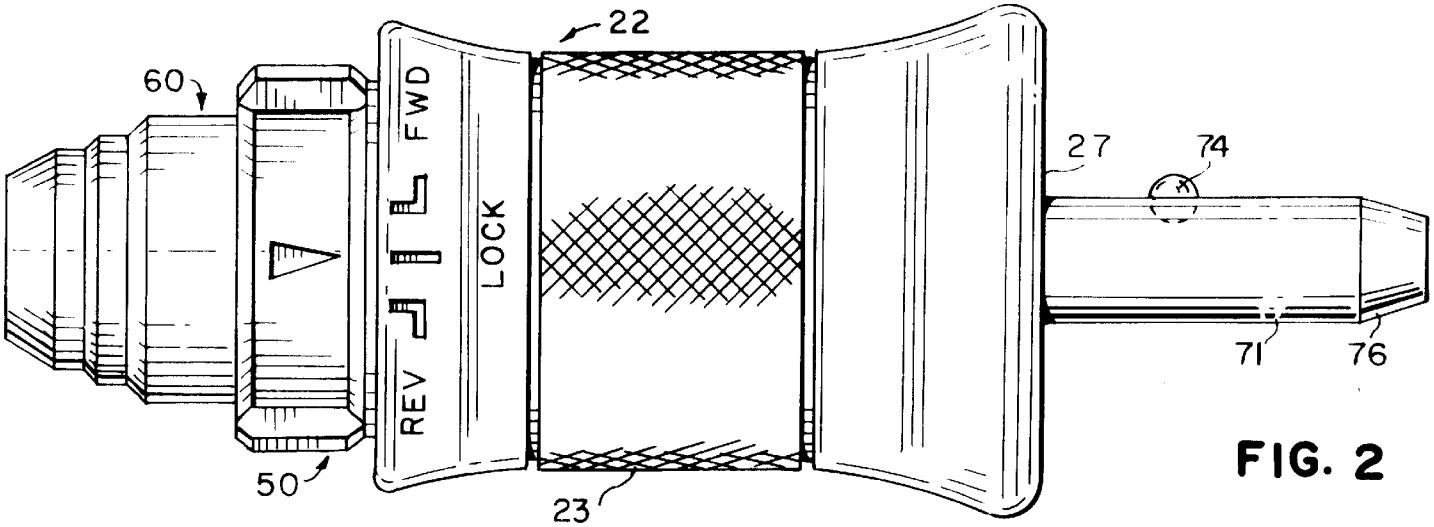
FIG. 2 is an enlarged side elevational view of the ratchet mechanism if the tool of FIG. 1.
Figure 3:
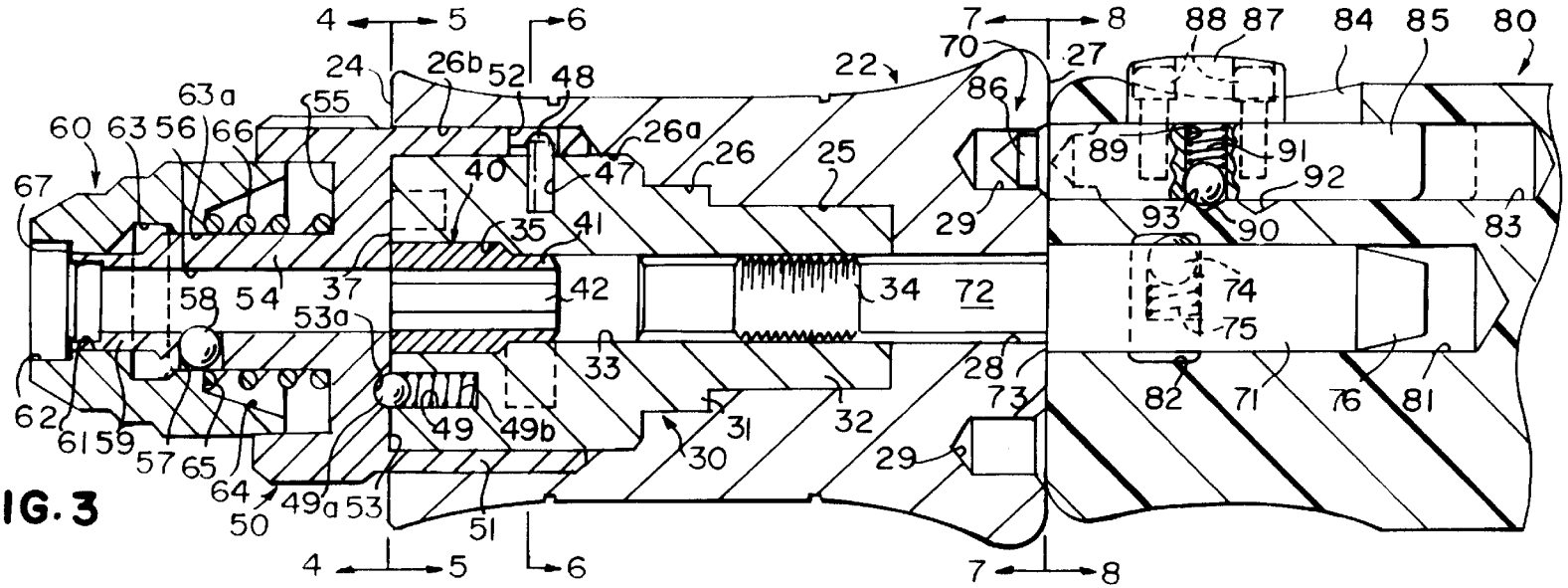
FIG. 3 is an enlarged, fragmentary view of the tool of FIG. 1 in vertical section, with the handle assembled and the bit removed.
Figure 7:
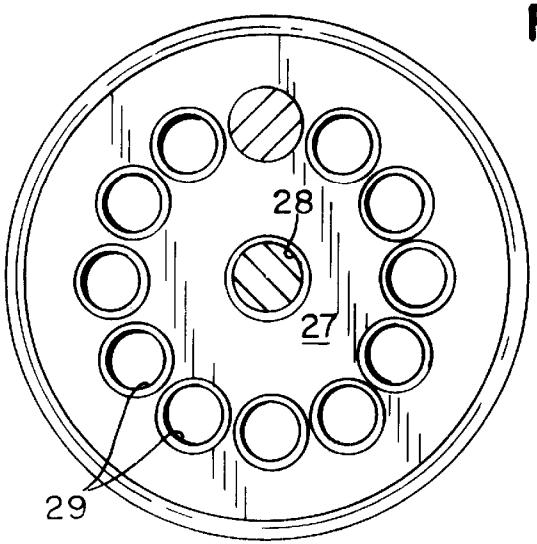
FIG. 7 is a sectional view taken along the line 7—7 in FIG. 3.
Figure 9:
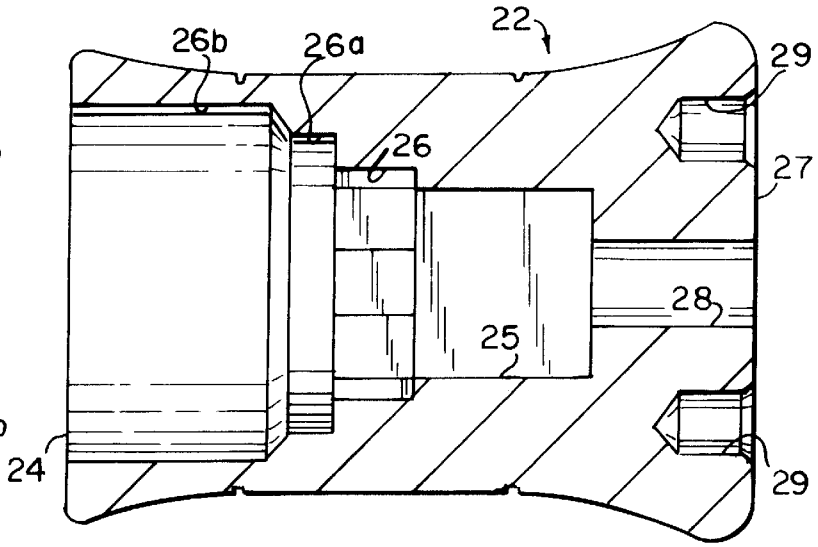
FIG. 9 is a vertical sectional view, like that of FIG. 3, of the housing of the ratchet mechanism.
Figure 10:
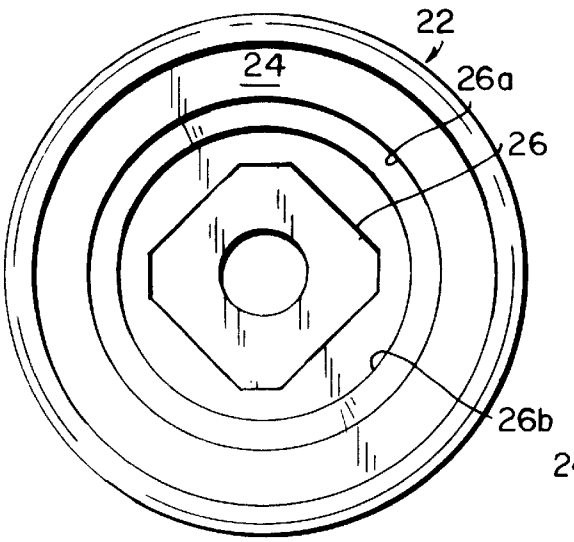
FIG. 10 is an end elevational view of the housing of FIG. 9, as viewed from the left-hand end thereof.
Figure 11:
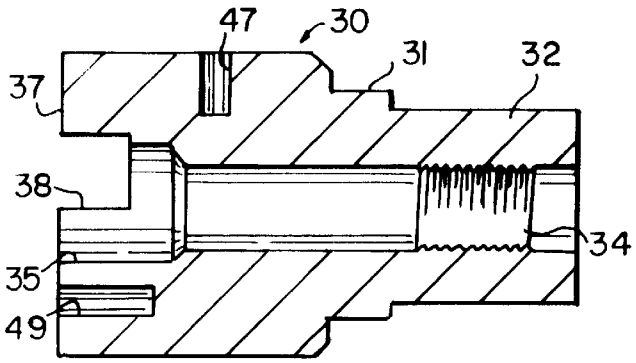
FIG. 11 is a vertical sectional view, like that of FIG. 3, of the ratchet insert of the ratchet mechanism.
Figure 12:
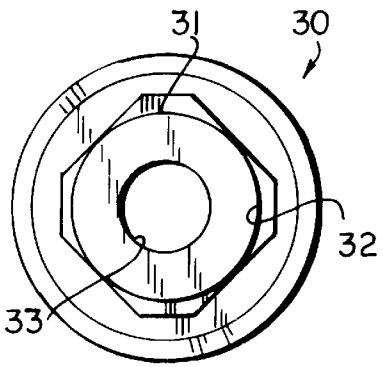
FIG. 12 is an end elevational view of the ratchet insert of FIG. 11, as viewed from the right-hand end thereof.

Referring to FIGS. 1–3, there is illustrated a ratchet tool, generally designated by the numeral 20, in accordance with the present invention. The tool 20 includes a ratchet mechanism 21 including a reverser 50 and a coupler 60 which cooperate to form a quick-release coupling mechanism for coupling an associated bit 68, and further having a handle assembly 70 including a post 71 and an associated handle 80 connectible in a quick-release coupling. Referring also to FIGS. 7, 9 and 10, the ratchet mechanism 21 includes a generally cylindrical housing body 22 with outwardly flared ends and a circularly cylindrical central portion with a knurled outer surface 23 to facilitate gripping. The housing body 22 has an axial bore 25, milled at its forward end to form a generally square crosssection portion 26, forwardly of which are formed counterbores 26*a* and 26*b*. The housing body 22 has a circular rear end surface 27 with an axial bore 28 which communicates with the bore 25 but has a substantially smaller diameter. Formed in the rear end surface 27 around the axial bore 28 are a circular array of peripheral recesses 29, each extending substantially parallel to the axis of the housing body 22.

Referring also to FIGS. 5, 6, 11 and 12, the ratchet mechanism 21 includes a generally cylindrical ratchet insert 30, the main body of which is dimensioned to fit in the counterbore 26*a* of the housing body 22, the insert 30 having a reduced section 31 substantially square in transverse cross section, and a further reduced cylindrical end 32, respectively dimensioned to fit in the square portion 26 and the bore 25 of the housing body 22. The insert 30 has an axial bore 33 therethrough with an internally threaded portion 34 adjacent to the rear end thereof, and a counterbore 35 at the forward end thereof. The insert 30 has a front end face 37 and is dimensioned so that, when fully seated in the housing body 22, the end face 37 is substantially coplanar with the front end surface of the housing body 22, as can best be seen in FIG. 3. Formed in the front face 37 are pawl cutouts or recesses 38. A pair of bores 39 are formed in the insert 30 extending outwardly toward the periphery of the insert 30 from the pawl cutouts 38 (one shown in FIG. 5).

Figure 6:
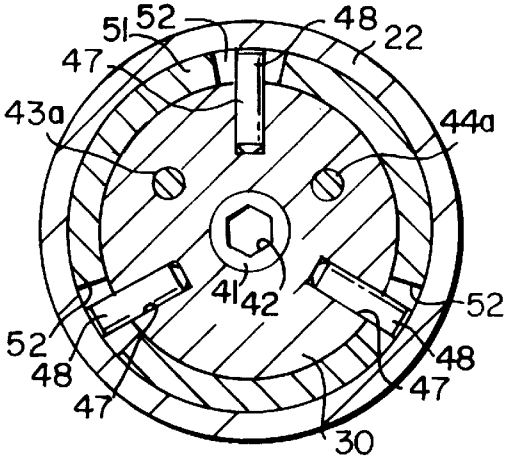
FIG. 6 is a sectional view taken along the line 6—6 in FIG. 3.
Figure 5:
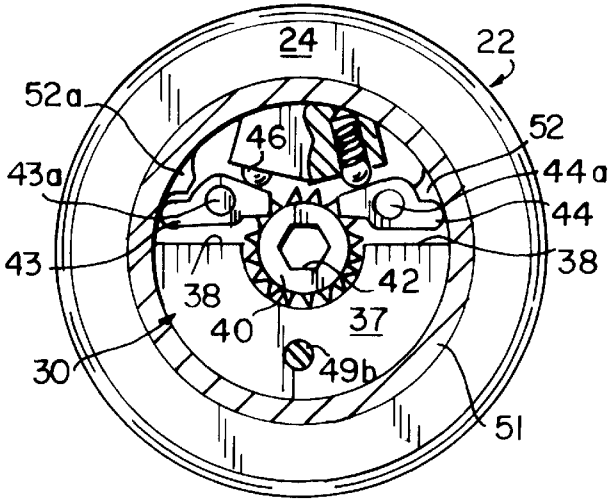
FIG. 5 is a sectional view taken along the line 5—5 in FIG. 3.
Figure 8:
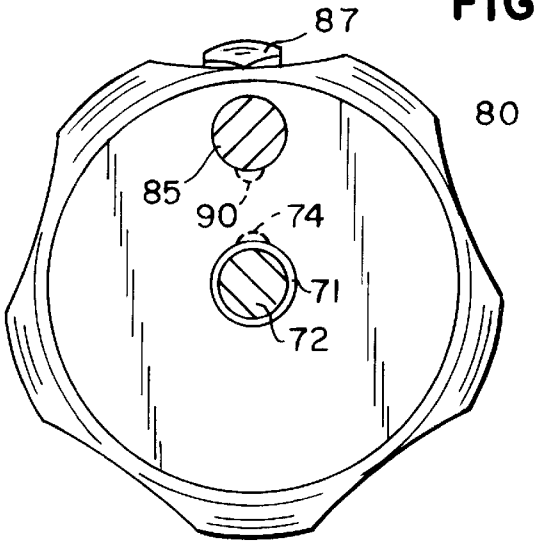
FIG. 8 is a sectional view taken along the line 8—8 in FIG. 3.

Referring in particular to FIGS. 3, 5 and 6, the ratchet mechanism 21 includes a ratchet gear 40, which is rotatably received in the counterbore 35 of the insert 30, and has a reduced end 41 received in the bore 33 of the insert 30. The gear 40 has an axial passage 42 therethrough, hexagonal in transverse cross section. Two pawls 43 and 44 are respectively disposed in the pawl recesses 38 for pivotal movement about pivot pins 43*a* and 44*a*, respectively received in complementary bores (not shown) in insert 30, for pivotal movement into and out of engagement with the teeth of the gear 40, in a known manner. Springs 45 are respectively received in the bores 39 and respectively urge balls 46 into engagement with the pawls 43 and 44 for resiliently biasing them to a neutral or non-ratcheting position, illustrated in FIG. 5, wherein both are engaged with the gear 40. The insert 30 is also provided with three substantially equiangularly spaced radial bores 47 in the outer surface thereof, respectively receiving pins 48 which project outwardly a predetermined distance beyond the outer surface of the insert 30, as is best illustrated in FIG. 6, for a purpose to be explained more fully below. Formed in the end face 37 of the ratchet insert 30, beneath the axial bore 33 and parallel thereto, is a bore 49 for receiving a spring 49*a* and ball 49*b* for a purpose to be explained below.

Figure 4:
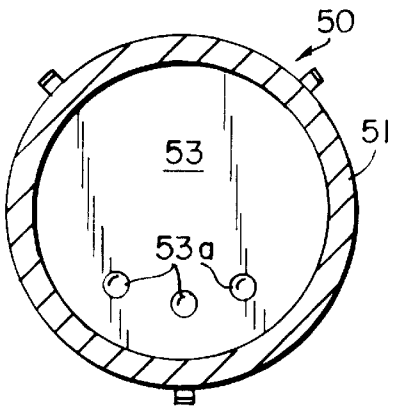
FIG. 4 is a sectional view taken along the line 4—4 in FIG. 3.
Figure 15:
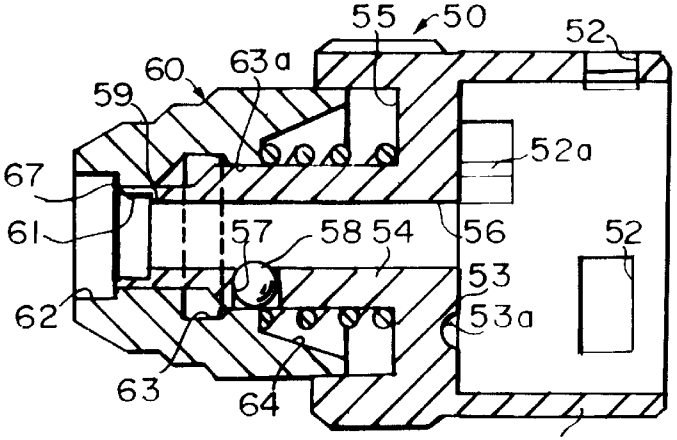
FIG. 15 is a vertical sectional view of the coupling assembly of FIG. 13.
Figure 14:
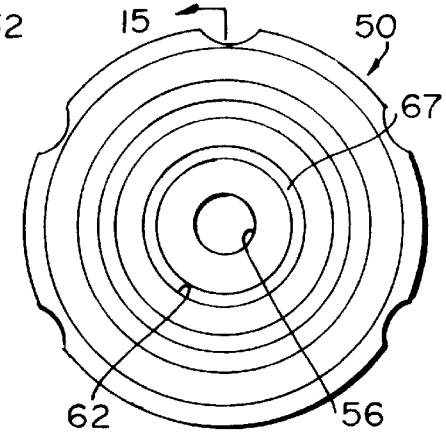
FIG. 14 is an end elevational view of the coupling assembly of FIG. 13, as viewed from the left-hand end thereof.
Figure 13:
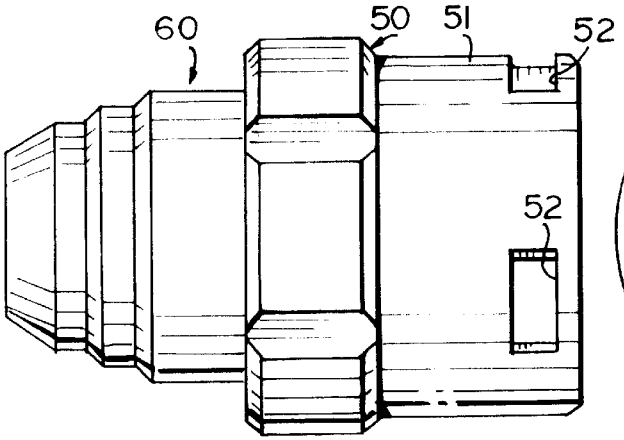
FIG. 13 is a side elevational view of the bit coupling assembly of the ratchet mechanism of FIG. 2.

The reverser 50 is a generally cylindrical member having a rearwardly projecting cylindrical flange 51 receivable in the counterbore 26*b* between the housing body 22 and the ratchet insert 30, as can best be seen in FIGS. 3 and 6. Referring also to FIGS. 13–15, the flange 51 has formed therethrough three equiangularly spaced slots 52, each having a predetermined circumferential extent and respectively receiving therein the outer ends of the pins 48. The flange 51 is dimensioned so that the reverer 40 can rotate relative to the housing body 22 and the ratchet insert 30 about the axis thereof, the extent of rotation being limited by the engagement of the pins 48 at the ends of the slots 51. Projecting radially inwardly from the inner surface of the flange 51 adjacent to its forward end are two projections 52, respectively disposed for engagement with pawls 43 and 44 (see FIG. 5), for respectively pivoting the pawls out of engagement with the gear 40 as the reverser 50 is rotated counterclockwise or clockwise from the neutral position, as viewed in FIG. 5. Thus, it will be appreciated that the reverser 50 is rotatable to selectively shift the ratchet mechanism 21 among its neutral or non-ratcheting, forward ratcheting and reverse ratcheting conditions, in a known manner. The reverser 50 has a circular end face 53 at the forward end of the flange 51, in which are formed three detent recesses 53*a* (FIGS. 4 and 15), for receiving the spring-loaded ball 49*b* to retain the ratchet mechanism 21 in the selected one of its three operating conditions.

The reverser 50 has a reduced-diameter cylindrical post 54 which projects forwardly therefrom, the reverser having an annular recess 55 formed around the inner or rear end of the post 54. The post 54 has axial bore 56 therethrough which extends through the end face 53, and a radial bore 57 which communicates with the axial bore 56. A detect ball 58 is received in the radial bore 57. The post 54 has a reduced outer diameter portion 59 adjacent to its distal end.

The coupler 60 is a generally cylindrical member having an axial bore 61 therethrough with a larger-diameter counterbore 62 at the forward end thereof. The bore 61 has an enlarged-diameter circumferential recess 63 formed therein intermediate the ends thereof, the recess 63 communicating at its rear end with an enlarged-diameter counterbores 63*a*, which in turn communicates with a frustoconical counterbore 64 at the rear end of the coupler 60, the counterbore 63*a* and 64 cooperating to define an annular shoulder 65 therebetween.

In use, the coupler 60 is dimensioned to fit over the post 54 of the reverser 50 and into the annular recess 55 thereof. More specifically, the counterbore 63*a* is dimensioned to fit over the main diameter of the post 54, while the axial bore 61 is dimensioned to fit over the reduced-diameter end portion 59 of the post 54. A helical compression spring 66 is seated in the recess 55 an encircles the post 54, bearing against the shoulder 65 to resiliently urge the coupler 60 axially outwardly or forwardly relative to the reverser 50. Preferably the reduced-diameter portion 59 of the post 54 has an outturned flange 67 at its distal end to seat in the counterbore 62 and limit forward movement of the coupler 60 and retain it on the post 54. When the parts are thus assembled, the counterbore 63*a* of the coupler 60 will be disposed over the radial bore 57 in the post 54, urging the ball 58 radially inwardly so that it projects into the axial bore 56 in a normal locking condition, illustrated in FIGS. 3 and 15. In this normal rest condition, the circumferential recess 63 is disposed forwardly of the radial bore 57.

Figure 17:
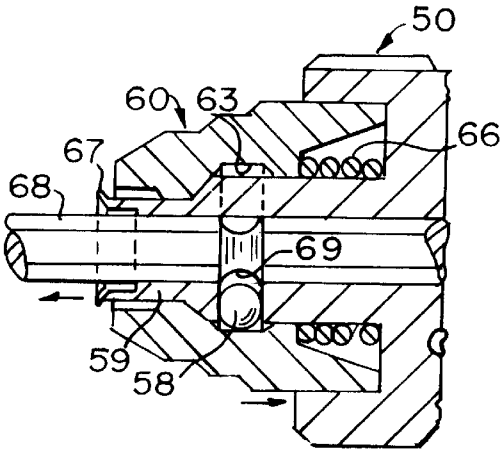
FIG. 17 is a view similar to FIG. 16, illustrating the coupling assembly in its bit-releasing position.
Figure 16:
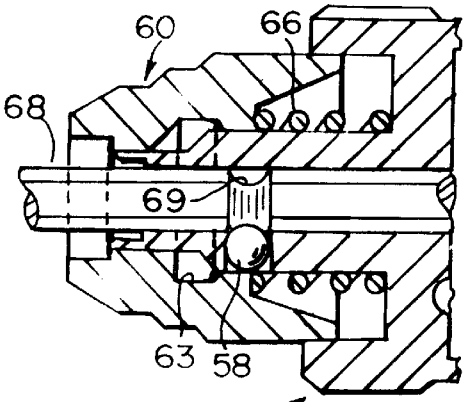
FIG. 16 is a fragmentary sectional view of the left-hand end of FIG. 3, showing the locked mode in position in the coupling assembly.

In operation, the reverser 50 and the coupler 60 cooperate to form a quick-release coupling mechanism for releasably retaining an associated bit 68, such as a screwdriver bit. Preferably, the bit 68 has a hexagonal shank with a detent groove 69 formed circumferentially therearound a predetermined distance from the rear end thereof. When it is desired to insert the bit 68 in the ratchet tool 20, the coupler 60 is depressed rearwardly into the recess 55 against the urging of the spring 66, as illustrated in FIG. 17, bringing the circumferential recess 63 into alignment with the radial bore 57, allowing the detent ball 58 to drop into the circumferential recess 63 and clear the axial bore 56, allowing free passage of the shank of the bit 68. Once the inner end of the bit shank clears the radial bore 57, the coupler 60 can be released and, when the bit 68 has been fully inserted, the forward biasing of the spring 66 will cam the detent ball 58 back into its normal position seated in the circumferential groove 69, as illustrated in FIG. 16. In this regard, the circumferential recess 63 is generally part-trapezoidal in transverse cross section to facilitate the camming action. In this condition, the bit 68 is latched in place with its inner end engaging in the hexagonal passage 42 in the ratchet gear 40. To remove the bit 68, the coupler 60 is again pressed rearwardly into the recess 55 to disengage the detent ball 58 and to permit the bit 68 to be pulled out.

Referring now to FIGS. 1–3, 7 and 8, the post 71 of the handle assembly 70 has a reduced-diameter end 72 externally threaded for threaded engagement in the threaded portion 34 of the axial bore 33 in the housing body 22. The reduced end 72 cooperates with the main body of the post 71 to form an annular shoulder 73 therebetween which seats against the rear end surface 27 of the housing body 22. The post 71 has a detent ball 74 and a bias spring 75 received in a radial bore therein in a well-known manner, the rear distal end of the post 71 being chamfered or tapered, as at 76, to facilitate insertion into an axial bore 81 in the handle 80. The bore 81 has a circumferential detent groove 82 formed therein for receiving the detent ball 74 to resiliently retain the handle 80 on the post 71 in a well-known manner, as illustrated in FIG. 3, the groove 82 having sloping front and rear ends to permit the ball 74 to be cammed out of the groove 82 to permit ready removal of the handle 80 by exertion of sufficient axial force. When the handle 80 is latched in place on the post 71 its forward end surface abuts against the rear end surface 27 of the housing body 22. Because the detent groove 82 is circumferential, the handle 80 can be freely rotated on the post 71 about its axis.

Also formed in the forward end face of the handle 80 parallel to the axis thereof is a bore 83, which communicates with a radially inwardly extending slot 84 which has a predetermined longitudinal extent. A latch pin 85 is slidably received in the bore 83 and has a tapered forward end 86 dimensioned to be received in a selected one of the recesses 29 in the housing body 22. A slider button 87 is fixed to the pin 85, as by screws 88, and projects radially outwardly through the slot 84. The pin 85 has a radial bore 89 therein receiving a detent ball 90 and a helical compression spring 91, which resiliently urges the ball 90 radially outwardly for engagement in a selected one of detent grooves 92 and 93 formed in the wall of the bore 83. In use, the slider button 87 is manually operable by the user's thumb or finger to slide the pin 85 in an axial direction between an extended position, illustrated in solid line in FIG. 3, engaging in a recess 29 of the housing body 22, and a retracted position, illustrated in broken line in FIG. 3, fully retracted into the handle 80. The detent ball 90 is received in the groove 92 in the retracted position and in the groove 93 in the extended position for resiliently retaining the pin 85 in the selected position. It will be appreciated that, in the extended position, the pin 85 locks the handle 80 to the housing body 22 for rotation therewith, while in the retracted position the handle 80 is freed for rotation relative to the housing body 22.

From the foregoing, it can be seen that there has been provided a ratchet tool with a ratchet mechanism, to which both a workpiece-engaging bit and a handle can be releasably attached with quick-release couplings, the handle, when coupled, being shiftable between a free-spinning condition relative to the ratchet mechanism and a latched condition rotatable with the ratchet mechanism.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A ratchet tool for driving a bit comprising:

a ratchet mechanism having a body, a first quick-release coupling mechanism carried by said body and releasably coupling a bit to the ratchet mechanism, a handle, and a second quick-release coupling mechanism releasably coupling said handle to said ratchet mechanism, said second coupling mechanism including a male portion with an axis and a female portion receiving said male portion coaxially therein, a first one of the male and female portions having a resiliently retractable detent member projecting radially therefrom, a second one of the male and female portions having a circumferential groove therein for receiving the detent member and accommodating free spinning rotational movement of said handle relative to said ratchet mechanism about the axis.

2. The ratchet tool of claim 1, wherein said body has opposed ends, said coupling mechanisms being respectively disposed at said ends.

3. The ratchet tool of claim 1, wherein said first coupling mechanism includes a reversing member engageable with said ratchet mechanism for controlling the direction of operation thereof.

4. The ratchet tool of claim 3, wherein said ratchet mechanism includes a pawl assembly, said reversing member including projection structure engageable with said pawl assembly.

5. The ratchet tool of claim 3, wherein said body has an annular recess therein, said reversing member including a cylindrical wall receivable in said recess and rotatable about the axis thereof.

6. The ratchet tool of claim 5, wherein said cylindrical wall has a slot therein, said body having a radially outwardly extending pin projecting into said slot for retaining the parts together and limiting rotational movement of said reversing member.

7. The ratchet tool of claim 1, wherein said male portion is on said body and said female portion is in said handle.

8. The ratchet tool of claim 7, wherein said detent member projects from said male portion and said circumferential groove is formed along an inner surface of said female portion.

9. A ratchet tool comprising:

a ratchet mechanism having a body, a handle, and coupling mechanism for coupling the handle to the ratchet mechanism, said coupling mechanism including a retaining portion operable for retaining the handle on the ratchet mechanism and accommodating relative rotational movement of the handle and the ratchet mechanism about a common axis, and a latching portion selectively operable for preventing relative rotational movement of the handle and the latching mechanism.

10. The ratchet tool of claim 9, wherein said retaining portion includes a post projecting from said body and having a resiliently retractable detent member extending radially therefrom, said handle having an axial bore receiving said post therein and a circumferential groove formed in said bore and receiving said detent member for accommodating free spinning rotation of said handle about the axis of said post.

11. The ratchet tool of claim 9, wherein said latching portion includes a recess formed in said body and a pin carried by said handle and movable relative thereto between an extended position receivable in said recess for locking said handle to said body and a retracted position withdrawn from said recess for accommodating free spinning rotation of said handle relative to said body.

12. The ratchet tool of claim 11, wherein said body has a plurality of recesses formed therein, said pin being receivable in any of said recesses in the extended position thereof.

13. The ratchet tool of claim 11, wherein said pin includes a resiliently retractable detent member carried thereby, said body having two detent recesses respectively receiving said detent member in the extended and retracted positions of said pin.

14. A ratchet tool for driving a bit comprising:

a ratchet mechanism having a body, a first quick-release coupling mechanism carried by said body and releasably coupling a bit to the ratchet mechanism, a handle, and a second quick-release coupling mechanism releasably coupling said handle to said ratchet mechanism, said second coupling mechanism including a retaining portion operable for retaining the handle on the ratchet mechanism and accommodating relative rotational movement of the handle and the ratchet mechanism about a common axis, and a latching portion selectively operable for preventing relative rotational movement of the handle and the latching mechanism.

15. The ratchet tool of claim 14, wherein said first coupling mechanism includes a reversing member engageable with said ratchet mechanism for controlling the direction of operation thereof.

16. The ratchet tool of claim 15, wherein said ratchet mechanism includes a pawl assembly, said reversing member including projection structure engageable with said pawl assembly.

17. The ratchet tool of claim 15, wherein said body has an annular recess therein, said reversing member including a cylindrical wall receivable in said recess and rotatable about the axis thereof, said cylindrical wall having a circumferentially extending slot therein, said body having a radially outwardly extending pin projecting into said slot for retaining the parts together and limiting rotational movement of said reversing member.

18. The ratchet tool of claim 14, wherein said retaining portion includes a post projecting from said body and having a resiliently retractable detent member extending radially therefrom, said handle having an axial bore receiving said post therein and a circumferential groove formed in said bore and receiving said detent member for accommodating free spinning rotation of said handle about the axis of said post.

19. The ratchet tool of claim 14, wherein said latching portion includes a recess formed in said body and a pin carried by said handle and movable relative thereto between an extended position receivable in said recess for locking said handle to said body and a retracted position withdrawn from said recess for accommodating free spinning rotation of said handle relative to said body.

20. The ratchet tool of claim 19, wherein said body has a plurality of recesses formed therein, said pin being receivable in any of said recesses in the extended position thereof.

* * * * *